US008579163B2

(12) United States Patent
Ellis

(10) Patent No.: US 8,579,163 B2
(45) Date of Patent: Nov. 12, 2013

(54) DENTAL RACK AND DISPENSER

(76) Inventor: Charmine Ellis, Brooklyn, NY (US)

( * ) Notice: Subject to any disclaimer, the term of this patent is extended or adjusted under 35 U.S.C. 154(b) by 0 days.

(21) Appl. No.: 13/288,422

(22) Filed: Nov. 3, 2011

(65) Prior Publication Data

US 2013/0112713 A1 May 9, 2013

(51) Int. Cl.
*B67D 1/07* (2006.01)

(52) U.S. Cl.
USPC ..... 222/192; 222/23; 222/129; 222/145; 222/156; 206/369; 211/66

(58) Field of Classification Search
USPC ..... 222/181.3, 180, 192, 181.1, 183, 157, 222/158, 129, 148, 23, 156; 206/368, 369, 206/209.1, 210, 207, 63.5, 581, 823, 361, 206/362.2, 15.2, 205; 211/163, 65–66; 312/125; 132/308–312
See application file for complete search history.

(56) References Cited

U.S. PATENT DOCUMENTS

| | | | | | |
|---|---|---|---|---|---|
| 1,485,850 | A | | 3/1924 | Hollander | |
| 1,614,054 | A | * | 1/1927 | Wolkenhauer | 222/93 |
| 1,713,379 | A | | 5/1929 | Fromwiller | |
| 2,105,892 | A | * | 1/1938 | Perry | 141/362 |
| 2,209,269 | A | * | 7/1940 | Hanni | 206/209.1 |
| 2,466,628 | A | | 4/1949 | Waiters | |
| 2,579,242 | A | * | 12/1951 | Pask | 250/455.11 |
| 2,605,932 | A | * | 8/1952 | Locke | 222/80 |
| 2,611,477 | A | * | 9/1952 | Keys | 206/362.1 |
| 2,643,795 | A | | 6/1953 | Teal | |
| 2,652,306 | A | | 9/1953 | Lindsay | |
| 2,720,439 | A | * | 10/1955 | San Cristoval | 312/206 |
| 2,760,681 | A | * | 8/1956 | Arquelles et al. | 222/93 |
| 2,815,057 | A | * | 12/1957 | Tupper | 220/796 |
| 2,828,891 | A | * | 4/1958 | Murney | 222/192 |
| 3,138,414 | A | * | 6/1964 | La Pollo | 312/207 |
| 3,241,721 | A | * | 3/1966 | Freeman | 222/93 |
| 3,679,087 | A | * | 7/1972 | Poli | 220/478 |
| 3,698,779 | A | * | 10/1972 | Holmes et al. | 312/126 |
| 3,748,094 | A | * | 7/1973 | Scheidell | 312/207 |
| 3,860,147 | A | * | 1/1975 | Vessio et al. | 222/96 |
| 3,954,407 | A | * | 5/1976 | Andary et al. | 250/455.11 |
| 4,056,110 | A | | 11/1977 | Landsman | |
| 4,121,600 | A | | 10/1978 | Riddick | |
| 4,124,262 | A | * | 11/1978 | Schill | 312/305 |
| 4,234,087 | A | | 11/1980 | Pandak | |
| 4,448,329 | A | | 5/1984 | Vilaseca et al. | |
| 4,473,152 | A | * | 9/1984 | Jump et al. | 206/209.1 |
| 4,508,242 | A | * | 4/1985 | Wolfe | 222/102 |
| 4,950,902 | A | * | 8/1990 | Ritter | 250/455.11 |
| D319,875 | S | * | 9/1991 | Lackey et al. | D24/217 |
| 5,183,182 | A | * | 2/1993 | Comstock et al. | 222/129 |
| 5,185,532 | A | * | 2/1993 | Zabsky et al. | 250/455.11 |
| 5,271,529 | A | * | 12/1993 | Stuber | 222/103 |
| 5,277,332 | A | | 1/1994 | Rogers | |
| 5,332,107 | A | * | 7/1994 | Williams | 211/88.01 |

(Continued)

*Primary Examiner* — Paul R Durand
*Assistant Examiner* — Randall Gruby
(74) *Attorney, Agent, or Firm* — Maier & Maier, PLLC

(57) ABSTRACT

A dental rack and dispenser. The dental rack and dispenser can include a toothpaste compartment, the toothpaste compartment further having an openable cover and receiving a toothpaste canister through the openable cover, a toothpaste dispensing mechanism disposed inside the toothpaste compartment and operably coupling to the toothpaste canister, a plurality of openable toothbrush containers, each toothbrush container further having an interior for receiving a toothbrush therein, the interior of each toothbrush container being isolated from the interiors of the other toothbrush containers, and a wall-mountable structure coupled to the toothpaste compartment and the toothbrush containers.

17 Claims, 4 Drawing Sheets

(56) References Cited

U.S. PATENT DOCUMENTS

| | | | | | |
|---|---|---|---|---|---|
| 5,335,798 | A * | 8/1994 | Bonwell et al. | 211/65 |
| 5,449,092 | A * | 9/1995 | Bazan | 222/93 |
| D368,612 | S * | 4/1996 | Amin | D6/541 |
| 5,566,823 | A * | 10/1996 | Summers | 206/209.1 |
| 5,662,130 | A * | 9/1997 | Wiltshire | 132/323 |
| 5,676,279 | A * | 10/1997 | Bastion | 222/93 |
| 5,718,335 | A * | 2/1998 | Boudreaux | 206/461 |
| 5,769,245 | A * | 6/1998 | Butler | 211/65 |
| D395,972 | S * | 7/1998 | Levy | D6/515 |
| D398,150 | S * | 9/1998 | Vonarburg | D3/302 |
| 5,842,609 | A * | 12/1998 | Higgins et al. | 222/181.3 |
| 5,845,813 | A * | 12/1998 | Werner | 222/101 |
| 5,921,692 | A * | 7/1999 | Weber | 401/119 |
| 6,171,559 | B1 * | 1/2001 | Sanders et al. | 422/300 |
| 6,360,884 | B1 * | 3/2002 | Smith et al. | 206/209.1 |
| D457,004 | S * | 5/2002 | Brown, Jr. | D6/301 |
| 6,454,133 | B1 * | 9/2002 | Lopez et al. | 222/102 |
| 6,547,104 | B1 * | 4/2003 | Wilkinson | 222/192 |
| D492,869 | S * | 7/2004 | Henry | D6/534 |
| 6,789,701 | B1 * | 9/2004 | Smith | 222/95 |
| 6,827,212 | B2 * | 12/2004 | Reaux | 206/372 |
| 7,188,629 | B2 * | 3/2007 | Mehes et al. | 132/310 |
| 7,401,699 | B1 | 7/2008 | Griffin, Jr. | |
| 7,520,407 | B2 * | 4/2009 | Crosby et al. | 222/102 |
| 7,669,735 | B1 * | 3/2010 | Alleyne | 222/102 |
| 7,882,949 | B1 * | 2/2011 | Singh | 206/361 |
| 7,950,534 | B2 * | 5/2011 | Kao | 211/70.6 |
| 8,074,814 | B2 * | 12/2011 | Morris et al. | 211/65 |
| D670,116 | S * | 11/2012 | Amato | D6/534 |
| 2002/0088474 | A1 * | 7/2002 | Montalvo | 132/309 |
| 2002/0096607 | A1 * | 7/2002 | Strunk | 248/111 |
| 2002/0166874 | A1 * | 11/2002 | DeVaux | 222/181.3 |
| 2004/0040980 | A1 * | 3/2004 | Chen | 222/101 |
| 2005/0109662 | A1 | 5/2005 | Kirk | |
| 2006/0175554 | A1 * | 8/2006 | Riddell | 250/455.11 |
| 2007/0158518 | A1 * | 7/2007 | Kurdoghlian | 248/312 |
| 2009/0321477 | A1 | 12/2009 | Baca | |
| 2012/0104037 | A1 * | 5/2012 | Ben-Shoshan | 222/1 |

* cited by examiner

DENTAL RACK AND DISPENSER

BACKGROUND

Toothpaste, toothbrushes, and other dental care tools are frequently kept in bathrooms while being exposed to the surrounding environment of the bathrooms. This can increase the likelihood of the dental care tools being exposed to mold, mildew, unsafe detergents, water spray, and other substances that can contaminate the dental tools. The dental tools can also come into contact with each other, increasing the likelihood of cross-contamination between the dental tools. Furthermore, many bathrooms have limited space and significant clutter, resulting in the dental tools being difficult to locate and as well as in the dental tools being placed into potentially unsanitary locations. A solution for sanitary maintenance of dental tools in a bathroom or other area is therefore desired.

SUMMARY

According to at least one exemplary embodiment, a dental rack and dispenser is disclosed. The dental rack and dispenser can include a toothpaste compartment, the toothpaste compartment further having an openable cover and receiving a toothpaste canister through the openable cover, a toothpaste dispensing mechanism disposed inside the toothpaste compartment and operably coupling to the toothpaste canister, a plurality of openable toothbrush containers, each toothbrush container further having an interior for receiving a toothbrush therein, the interior of each toothbrush container being isolated from the interiors of the other toothbrush containers, and a wall-mountable structure coupled to the toothpaste compartment and the toothbrush containers.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1:
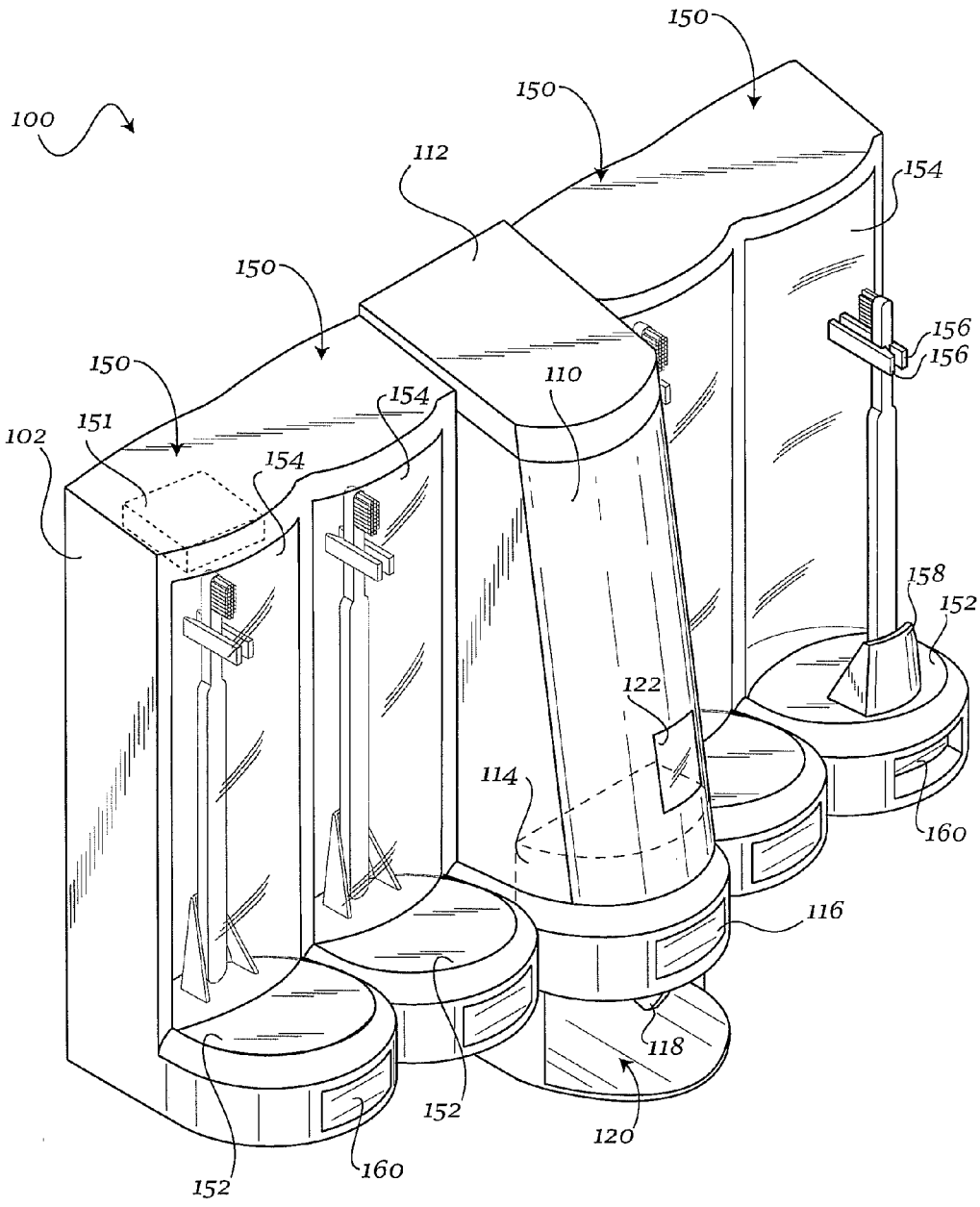
FIG. 1 is a perspective view of a first exemplary embodiment of a dental rack and dispenser.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Generally referring to FIGS. 1-4, a dental rack and dispenser may be disclosed. The dental rack and dispenser can include a toothpaste compartment for receiving a toothpaste canister, a user-operable toothpaste dispensing mechanism, a plurality of toothbrush containers, and a wall-mountable structure supporting the components of the dental rack. The dental rack and dispenser may further include a floss compartment. The components of the dental rack and dispenser, or portions thereof, may be formed from any desired material or combination of materials, for example plastic, may have any desired color, and may be opaque, transparent or translucent. The dental rack and dispenser can provide a centralized, sanitary, and ventilated location for storing dental tools and isolating dental tools so as to reduce the likelihood of contamination.

The toothpaste compartment may include an openable cover which may couple to the toothpaste compartment so as to form a seal sufficient to prevent the spread of moisture, bacteria, fungi and other undesirable elements into the toothpaste compartment. Disposed within the toothpaste compartment may be a toothpaste dispensing mechanism adapted to couple with a toothpaste canister. The toothpaste dispensing mechanism may be user-operable by way of a button, lever, trigger, or any other user-operable member that enables the dispensing mechanism to function as described herein. In some exemplary embodiments, the toothpaste dispensing mechanism may be operable manually. Alternatively, in some exemplary embodiments, the toothpaste dispensing mechanism may be electrically powered, and may include a sensor, for example a proximity sensor or a motion sensor that can enable the user to operate the toothpaste dispensing mechanism by interacting with the sensor. Such embodiments can include any electronic components that enable the dental rack and dispenser to function as described herein.

The toothpaste canister may be sized and shaped so as to be disposed within the toothpaste compartment and adapted to couple with the toothpaste dispensing mechanism. The toothpaste canister may be transparent or translucent to facilitate viewing of the toothpaste level within the toothpaste canister. A toothpaste indicator, for example a translucent or transparent element, may be provided in a user-observable location for viewing the amount of toothpaste remaining in the toothpaste canister and/or an indication that the toothpaste canister is in need of replacement. A recess may be disposed proximate the toothpaste dispensing mechanism. The recess may be sized and shaped to receive the head of a toothbrush such that the toothpaste may be dispensed onto the head of the toothbrush.

The toothpaste compartment may be coupled to a wall-mountable structure, for example a housing, enclosure, rack, plate or any structure that enables the toothpaste rack and dispenser to function as described herein. Coupled to the wall-mountable structure may be a plurality of toothbrush containers. Each toothbrush container may enclose a hollow interior within which a single toothbrush may be received. The interiors of the toothbrush containers may be separated from each other by any desired structure, such that there is no communication between the interiors of the toothbrush containers, reducing the likelihood of cross-contamination between any of the toothbrushes disposed within the toothbrush containers.

Each of the toothbrush containers may be openable so as to allow for toothbrushes to be placed into and removed from the toothbrush containers. Each of the toothbrush containers may further include at least one retaining member sized and shaped to maintain a toothbrush in an upright, substantially vertical position within the toothbrush containers. Each toothbrush container may further include at least one aperture defined therein so as to facilitate ventilation of the toothbrush container as well as draining of liquids from the toothbrush container. Each toothbrush container may further be adapted to sanitize the toothbrush disposed therein. In some exemplary embodiments, each toothbrush container may include therein emitters of ultraviolet germicidal irradiation (UVGI). Such embodiments can include any electronic components that enable the dental rack and dispenser to function as described herein.

Each toothbrush container may further include diverse identifying indicia, for example color-coded indicia, letters, numbers, icons, and so forth that can enable the user to differentiate between the plurality of toothbrush containers. A toothbrush indicator may also be provided in a user-observable location on each toothbrush container for displaying the remaining usable life of the toothbrush contained therein and/or an indication that the toothbrush is in need of replacement.

Figure 2:
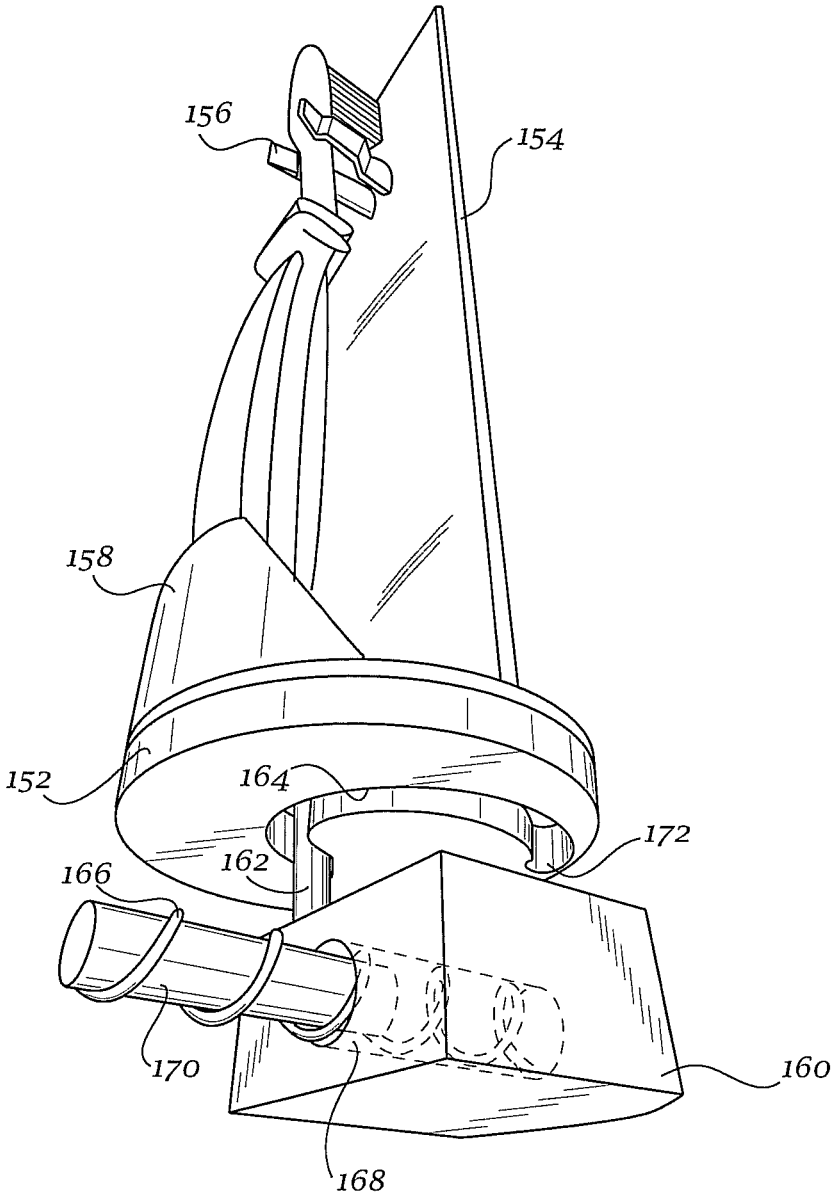
FIG. 2 is a perspective view of an exemplary rotatable base and shield of the embodiment of FIG. 1.

Turning to FIGS. 1-2, a first exemplary embodiment of a dental rack and dispenser 100 may be disclosed. Dental rack and dispenser 100 may include a housing 102, which may be formed as a unit and may be constructed from any desired material or combination of materials, may have any desired color and may be opaque, transparent or translucent. Housing 102 may include a rear surface which may include structures for coupling dispenser 100 to a vertical surface, such as a wall. Housing 102 may enclose or partially enclose a toothpaste compartment 110 and a plurality of toothbrush containers 150.

Toothpaste compartment 110 may include a plurality of exterior walls enclosing a substantially hollow interior, which can be sized and shaped to receive a toothpaste canister. A cover 112 may be disposed proximate the top portion of toothpaste compartment 110 or at any other location on toothpaste compartment 110. Cover 112 may be removably coupled to toothpaste compartment 110 so as to form a seal sufficient to prevent the spread of moisture, bacteria, fungi and other undesirable elements into the toothpaste compartment. To that end, additional sealing elements, for example rings, gaskets, and the like may be provided at the interface between toothpaste compartment 110 and cover 112. Such sealing elements may be formed from any desired material, for example rubber, a polymeric material, or any other material that enables dispenser 100 to function as described herein. In some exemplary embodiments, cover 112 may be coupled to toothpaste compartment 110 through the use of hinges, joints, couplings or fittings, or any other coupling mechanism that can allow for cover 112 to be opened, rotated or otherwise moved so as to allow for an opening to be formed in a portion of toothpaste compartment 110 through which a toothpaste canister may be inserted into the interior of the toothpaste compartment.

A toothpaste dispensing mechanism 114 may be disposed substantially at the bottom of toothpaste compartment 110, or at any other suitable location of toothpaste compartment 110. Toothpaste dispensing mechanism 114 can be adapted to couple with a toothpaste canister so as to facilitate withdrawing toothpaste from the canister. A dispensing button 116 may be coupled to toothpaste dispensing mechanism 114 so as to allow the user to operate the dispensing mechanism. In some exemplary embodiments, button 116 may be a lever, trigger, sensor, or any other member, electronic component, or mechanism that enables dispenser 100 to function as described herein. Any electronic components that enable dental rack and dispenser 100 to function as described herein may also be provided. Toothpaste dispensing mechanism 114 may further include a nozzle 118 via which the toothpaste may be deposited onto a toothbrush. Nozzle 118 may be disposed within a recess 120 into which the head of the toothbrush may be inserted. Recess 120 can be enclosed by a plurality of side walls and a bottom wall so as to facilitate cleanliness of the surrounding area by maintaining any dispensed toothpaste within the recess and reducing the likelihood of the dispensed toothpaste being deposited into the area surrounding dispenser 100.

A toothpaste indicator 122 may be provided in a user-observable location, for example on the exterior of toothpaste compartment 110. In some exemplary embodiments, the toothpaste indicator 122 can display the amount or level of toothpaste remaining in the toothpaste canister. For example, the toothpaste canister may be transparent or translucent, and the toothpaste indicator 122 may likewise be transparent or translucent, such that the level of toothpaste within the toothpaste canister may be visible. In some further exemplary embodiments, toothpaste indicator 122 can display an indication that the toothpaste canister is in need of replacement. For example, when the level of toothpaste within the canister reaches a certain level, a electronic, magnetic, or other type of sensor may be triggered, causing toothpaste indicator to illuminate or otherwise notify the user of a low toothpaste level. Any electronic components that enable dental rack and dispenser 100 to function as described herein may also be provided.

A plurality of toothbrush containers 150 may be enclosed or partially enclosed by housing 102. In some exemplary embodiments, and as shown in FIG. 1, a plurality of toothbrush containers 150 may be defined in housing 102, for example as vertically elongated recesses having a semicircular profile. Each toothbrush container 150 may further include a base 152 rotatably coupled to housing 102 and a shield 154 fixedly coupled to base 152. Shield 154 may be formed from any desired material, for example plastic, and may be transparent, translucent, or opaque. Shield 154 may engage with housing 102 so as enclose the interior of toothbrush container 150 and to reduce the likelihood of cross-contamination between the toothbrushes disposed within the toothbrush containers. In some exemplary embodiments, additional sealing elements, for example gaskets and the like may be provided at the interface between toothbrush container 150 and shield 154. Such sealing elements may be formed from any desired material, for example rubber, a polymeric material, or any other material that enables dispenser 100 to function as described herein. Each toothbrush container 150 may further be adapted to sanitize the toothbrush disposed therein. In some exemplary embodiments, each toothbrush container 150 may include therein a UVGI emitter 151. The UVGI emitter 151 may be activated by the user as desired, or may activate automatically when toothbrush container 150 is closed and when a toothbrush is located therein. Any electronic components that enable dental rack and dispenser 100 to function as described herein may also be provided.

Each toothbrush container 150 may include therein retaining structures for maintaining a toothbrush in an upright, substantially vertical position within the interior of the toothbrush container. Such retaining structures may include clips 156 projecting into the interior of toothbrush container 150. Clips 156 may be sized and positioned to releasably engage the neck of a toothbrush. Clips 156 may be coupled to, or may be formed as a part of shield 154. The retaining structures may also include a bracket 158 sized and positioned to engage the base of a toothbrush. Bracket 158 may be coupled to, or may be formed as part of base 152, and may project upwardly therefrom.

Base 152 may be rotatable, and may have an approximately 180° range of rotation so as to alternate between an open position and a closed position. When base 152 is in the closed position, the interior of a toothbrush container 150, as well as a toothbrush disposed therein, may be substantially enclosed between housing 102 and shield 154. When base 152 is in the open position, shield 154 may be disposed substantially within the recess defined in housing 102 such that the toothbrush is accessible to the user and may be withdrawn from the toothbrush container.

Rotation of each base 152 may be effected by a corresponding user-operable button 160 disposed proximate to base 152. Button 160 may be disposed within housing 102 substantially below base 152, or at any suitable location. In some exemplary embodiments, button 160 may be a lever, trigger, or any other user-operable member that enables dispenser 100 to function as described herein. Each of buttons 160 may further include diverse identifying indicia, for example color-coded indicia, letters, numbers, icons, and so forth.

Button 160 may be disposed in a cavity defined within housing 102 and may be movable between a normal state and a depressed state. Button 160 may engage base 152 such that the normal state of button 160 corresponds to the closed position of base 152, while the depressed state of button 160 corresponds to the open position of base 152. To that end, in some exemplary embodiments, a first pin 162 disposed on the top surface of button 160 may engage a groove 164 defined in the bottom surface of base 152. As button 160 translates between the normal position and the depressed position in a substantially linear direction, the movement of first pin 162 within groove 164 can induce a substantially circular movement of base 152, as shown in FIG. 2.

Button 160 may further be spring-biased to return to the normal position from the depressed position. In some exemplary embodiments, a resilient member, for example a coil spring 166 or the like may be received within a bore 168 defined in a rear wall of button 160. Spring 166 may further be coupled to a second pin 170, which in turn may be coupled to or may be formed as a part of housing 102. Button 160 may further be lockable in the depressed position. A notch 172 defined at an end of groove 164 can receive first pin 162 so as to facilitate locking button 160 in the depressed position and base 152 in the open position.

Figure 3:
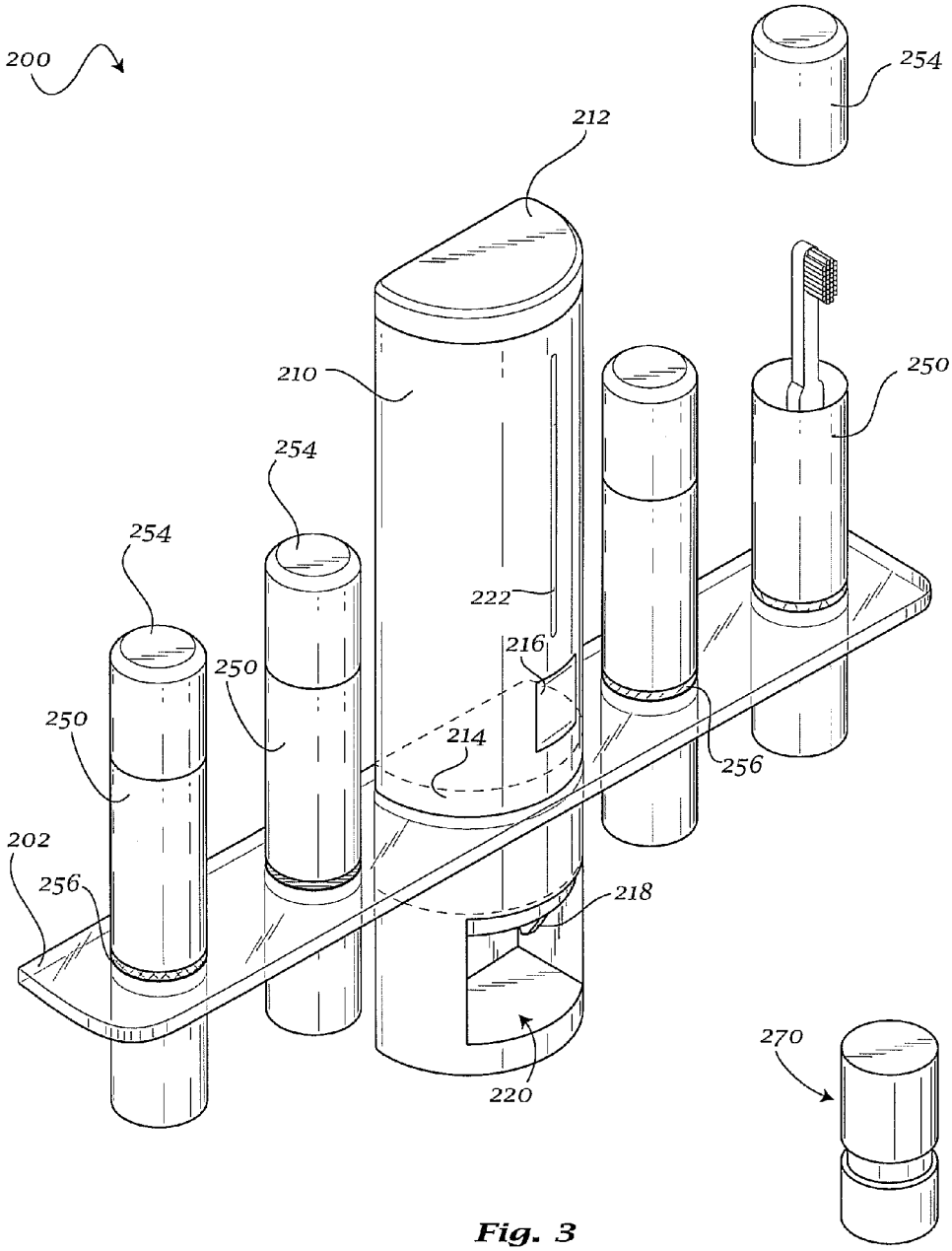
FIG. 3 is a perspective view of a second exemplary embodiment of a dental rack and dispenser.
Figure 4:
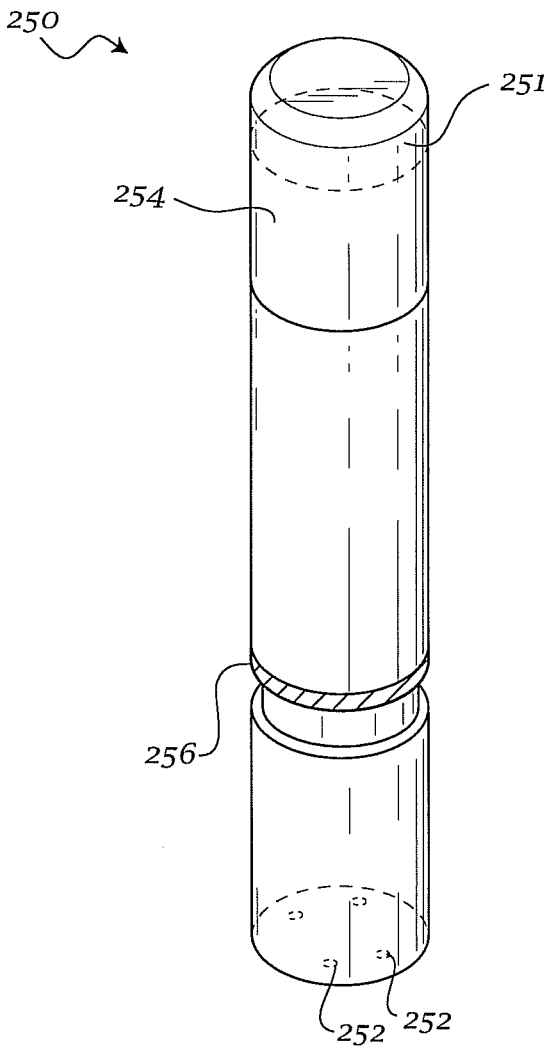
FIG. 4 is a perspective view of an exemplary toothbrush holder of the embodiment of FIG. 3.

Turning to FIGS. 3-4, another exemplary embodiment of a dental rack and dispenser 200 may be disclosed. Dental rack and dispenser 200 may include a plate 202, which may be formed as a unit and may be constructed from any desired material or combination of materials, may have any desired color and may be opaque, transparent or translucent. Plate 202 may be disposed substantially horizontally and may include structures for coupling dispenser 200 to a vertical surface, such as a wall. Plate 202 may further be coupled to a toothpaste compartment 210 and a plurality of toothbrush containers 250. Plate 202 may further be expandable so as to include additional toothpaste compartments 210, toothbrush containers 250, floss containers 270, or any combination thereof. Toothbrush containers 250, floss containers 270, toothpaste compartments 210 and any other desired containers may be modular so as to enable easy replacement or swapping of the various containers as desired by the user.

Toothpaste compartment 210 may have any desired shape; for example toothpaste compartment 210 may be shaped as a substantially vertically elongated semicircular cylinder, or any other shape that enables dispenser 200 to function as described herein. Toothpaste compartment 210 can enclose a substantially hollow interior, which can be sized and shaped to receive a toothpaste canister. A cover 212 may be disposed proximate the top portion of toothpaste compartment 210 or at any other location on toothpaste compartment 210. Cover 212 may be removably coupled to toothpaste compartment 210 so as to form a seal sufficient to prevent the spread of moisture, bacteria, fungi and other undesirable elements into the toothpaste compartment. To that end, additional sealing elements, for example rings, gaskets, and the like may be provided at the interface between toothpaste compartment 210 and cover 212. Such sealing elements may be formed from any desired material, for example rubber, a polymeric material, or any other material that enables dispenser 200 to function as described herein. In some exemplary embodiments, cover 212 may be coupled to toothpaste compartment 210 through the use of hinges, joints, couplings or fittings, or any other coupling mechanism that can allow for cover 212 to be opened, rotated or otherwise moved so as to allow for an opening to be formed in a portion of toothpaste compartment 210 through which a toothpaste canister may be inserted into the interior of the toothpaste compartment.

A toothpaste dispensing mechanism 214 may be disposed substantially at the bottom of toothpaste compartment 210, or at any other suitable location of toothpaste compartment 210. Toothpaste dispensing mechanism 214 can be adapted to couple with a toothpaste canister so as to facilitate withdrawing toothpaste from the canister. A dispensing button 216 may be coupled to toothpaste dispensing mechanism 214 so as to allow the user to operate the dispensing mechanism. In some exemplary embodiments, button 216 may be a lever, trigger, sensor, or any other member, electronic component, or mechanism that enables dispenser 200 to function as described herein. Any electronic components that enable dental rack and dispenser 200 to function as described herein may also be provided. Toothpaste dispensing mechanism 210 may further include a nozzle 218 via which the toothpaste may be deposited onto a toothbrush. Nozzle 218 may be disposed within a recess 220 into which the head of the toothbrush may be inserted. Recess 220 can be enclosed by a plurality of side walls and a bottom wall so as to facilitate cleanliness of the surrounding area by maintaining any dispensed toothpaste within the recess and reducing the likelihood of the dispensed toothpaste being deposited into the area surrounding dispenser 200.

A toothpaste indicator 222 may be provided in a user-observable location, for example on the exterior of toothpaste compartment 210. In some exemplary embodiments, the toothpaste indicator 222 can display the amount or level of toothpaste remaining in the toothpaste canister. In some further exemplary embodiments, toothpaste indicator 222 can display an indication that the toothpaste canister is in need of replacement.

A plurality of toothbrush containers 250 may be enclosed or partially enclosed by plate 202. In some exemplary embodiments, each toothbrush container 250 may be shaped as a vertically elongated cylinder enclosing a substantially hollow interior in which a toothbrush may be disposed. Each toothbrush container may further include a cap 254 removably coupled thereto, so as to form a seal sufficient to prevent the spread of moisture, bacteria, fungi and other undesirable elements into the toothbrush container. To that end, additional sealing elements, for example rings, gaskets, and the like may be provided at the interface between toothbrush container 250 and cap 254. Such sealing elements may be formed from any desired material, for example rubber, a polymeric material, or any other material that enables dispenser 100 to function as described herein. In some exemplary embodiments, a cap 254 may be coupled to a toothbrush container 250 through the use of hinges, joints, couplings or fittings, or any other coupling mechanism that can allow for cap 254 to be opened, rotated or otherwise moved so as to allow for an opening to be formed in a portion of toothbrush container 250 through which a toothbrush may be inserted into the interior of the toothbrush container. Each of toothbrush containers 250 may further include diverse identifying indicia 256, for example color-coded indicia, letters, numbers, icons, and so forth.

In some exemplary embodiments, each toothbrush container 250 may further include at least one aperture 252 defined therein so as to facilitate ventilation of the toothbrush container as well as draining of liquids from the toothbrush container. Each toothbrush container 250 may further be adapted to sanitize the toothbrush disposed therein. In some exemplary embodiments, each toothbrush container 250 may include therein a UVGI emitter 251. UVGI emitter 251 may be disposed, for example, within cap 254 of toothbrush container 250. UVGI emitter 251 may be activated by the user as desired, or may activate automatically when toothbrush container 250 is closed and when a toothbrush is located therein. Any electronic components that enable dental rack and dispenser 200 to function as described herein may also be provided.

Each toothbrush container 250 may include therein retaining structures for maintaining a toothbrush in an upright, substantially vertical position within the interior of the toothbrush container. Such retaining structures may include clips projecting into the interior of toothbrush container 250. The clips may be sized and positioned to releasably engage the neck of a toothbrush. The clips may be coupled to, or may be formed as a part of toothbrush container 250. The retaining structures may also include a bracket sized and positioned to engage the base of a toothbrush. The bracket may be coupled to, or may be formed as part of toothbrush container 250, and may project upwardly therefrom.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A dental rack and dispenser, comprising:

a toothpaste compartment, the toothpaste compartment further having an openable cover and receiving a toothpaste canister through the openable cover;

a toothpaste dispensing mechanism disposed inside the toothpaste compartment and operably coupling to the toothpaste canister;

a plurality of openable toothbrush containers, each toothbrush container further having an interior for receiving a toothbrush therein, the interior of each toothbrush container being isolated from the interiors of the other toothbrush containers; and a wall-mountable structure coupled to the toothpaste compartment and the toothbrush containers;

wherein each toothbrush container comprises a stationary portion, a rotatable base, and a shield coupled to the base, the rotatable base and shield being movable in a 180° range of rotation between a closed position enclosing the interior and an open position allowing access to the toothbrush, such that, when in the open position, the shield is disposed within the stationary portion.

2. The dental rack and dispenser of claim 1, further comprising:

a toothpaste replacement indicator disposed on the toothpaste compartment.

3. The dental rack and dispenser of claim 1, further comprising at least one retaining member disposed in each of the toothbrush containers, for maintaining a toothbrush in an upright position.

4. The dental rack and dispenser of claim 1, wherein each toothbrush container comprises:

a vertically elongated, hollow cylindrical enclosure; and a cap removably coupled to the enclosure.

5. The dental rack and dispenser of claim 1, wherein the wall-mountable structure comprises a substantially horizontal plate.

6. The dental rack and dispenser of claim 1, wherein the wall-mountable structure comprises a housing partially enclosing the plurality of toothbrush containers.

7. The dental rack and dispenser of claim 6, wherein each toothbrush container comprises:

an elongated recess defined in the housing;

a base rotatably coupled to the housing; and a shield fixedly coupled to the base.

8. The dental rack and dispenser of claim 1, wherein each toothbrush container is adapted to sanitize the toothbrush disposed therein.

9. The dental rack and dispenser of claim 1, each of the plurality of openable toothbrush containers further comprising diverse identifying indicia.

10. The dental rack and dispenser of claim 1, further comprising at least one UVGI emitter.

11. A dental rack and dispenser, comprising:

a housing;

a substantially hollow toothpaste compartment defined in the housing, the toothpaste compartment further having an openable cover and receiving a toothpaste canister through the openable cover;

a toothpaste dispensing mechanism disposed inside the toothpaste compartment and operably coupling to the toothpaste canister;

a plurality of elongated recesses defined in the housing;

a rotatable base member disposed proximate to each of the plurality of elongated recesses; and a shield coupled to the rotatable base member, the shield engaging the housing so as to enclose an interior volume for receiving a toothbrush therein;

wherein the rotatable base member and shield are movable in a 180° range of rotation between a closed position enclosing the interior volume and an open position allowing access to the toothbrush, such that, when in the open position, the shield is disposed within a corresponding elongated recess.

12. The dental rack and dispenser of claim 11, further comprising toothbrush retaining structures disposed within the interior volume.

13. The dental rack and dispenser of claim 11, further comprising a button operably coupled to each rotatable base member.

14. The dental rack and dispenser of claim 13, each button further comprising diverse identifying indicia.

15. The dental rack and dispenser of claim 11, wherein the interior volumes enclosed by the shields and the elongated recesses are isolated from each other.

16. The dental rack and dispenser of claim 11, further comprising a toothpaste replacement indicator disposed on the toothpaste compartment.

17. The dental rack and dispenser of claim 11, further comprising at least one UVGI emitter.

* * * * *